US007086346B1

(12) United States Patent
Van Horn et al.

(10) Patent No.: US 7,086,346 B1
(45) Date of Patent: Aug. 8, 2006

(54) APPARATUS AS A FLAG OR BANNER POLE CLIP

(76) Inventors: Steven M. Van Horn, HCR 67 Box 168 A, Mifflin, PA (US) 17058; Vicki L. Van Horn, HCR 67 Box 168 A, Mifflin, PA (US) 17058

( * ) Notice: Subject to any disclaimer, the term of this patent is extended or adjusted under 35 U.S.C. 154(b) by 0 days.

(21) Appl. No.: 10/942,064

(22) Filed: Sep. 16, 2004

(51) Int. Cl.
*G09F 17/00* (2006.01)

(52) U.S. Cl. ..... 116/173; 24/518; 24/505

(58) Field of Classification Search ..... 116/173, 116/28 R, 63 P; 40/658, 607.09; 24/518, 24/511, 505
See application file for complete search history.

(56) References Cited

U.S. PATENT DOCUMENTS

| | | | | | |
|---|---|---|---|---|---|
| 157,475 | A | * | 12/1874 | Johnson | 24/511 |
| 310,652 | A | | 1/1885 | Coolbaugh | |
| 363,533 | A | * | 5/1887 | Munger | 24/511 |
| 690,837 | A | * | 1/1902 | Conzett | 24/67.3 |
| 872,587 | A | * | 12/1907 | Spruce | 223/96 |
| 1,025,904 | A | * | 5/1912 | Earhart | 116/173 |
| 1,036,168 | A | * | 8/1912 | Updike | 116/173 |
| 1,306,073 | A | * | 6/1919 | Mertens | 24/511 |
| 1,532,381 | A | | 4/1925 | Clark | |
| 1,681,595 | A | * | 8/1928 | Ray | 248/229.1 |
| 2,332,997 | A | * | 10/1943 | Forbell | 116/173 |
| 2,409,411 | A | * | 10/1946 | Zedler | 116/173 |
| 2,461,333 | A | * | 2/1949 | MacCaferri | 24/501 |
| 2,491,737 | A | | 12/1949 | Kane | |
| 2,525,985 | A | * | 10/1950 | Weymouth | 24/511 |
| 2,527,357 | A | * | 10/1950 | Donahey | 116/173 |
| 3,593,386 | A | * | 7/1971 | Hug | 24/457 |
| 3,947,138 | A | * | 3/1976 | Eshelman | 402/69 |
| 4,145,793 | A | * | 3/1979 | Berlet | 24/501 |
| 4,852,733 | A | | 8/1989 | Blume | |
| 5,423,831 | A | * | 6/1995 | Nates | 606/120 |
| D370,623 | S | | 6/1996 | Wenger | |
| 5,533,464 | A | * | 7/1996 | Todd | 116/174 |
| 5,735,230 | A | * | 4/1998 | Romesburg | 116/173 |
| 5,975,009 | A | | 11/1999 | Nihra | |
| 6,105,218 | A | * | 8/2000 | Reekie | 24/518 |
| 6,322,571 | B1 | * | 11/2001 | Adams | 606/151 |
| 6,477,751 | B1 | * | 11/2002 | Baumdicker et al. | 24/559 |
| 6,619,479 | B1 | * | 9/2003 | Jones et al. | 206/554 |
| 6,913,233 | B1 | * | 7/2005 | Puett, III et al. | 248/229.1 |
| 6,935,268 | B1 | * | 8/2005 | Hawkins | 116/173 |
| 2005/0022862 | A1 | * | 2/2005 | Cudzinovic et al. | 136/256 |

* cited by examiner

*Primary Examiner*—Diego Gutierrez
*Assistant Examiner*—Travis Reis

(57) ABSTRACT

A device to secure a flag or banner to a pole. The securing device has an unshaped spring above a pivot dowel and in between a first and a second panel. Also, the securing device has snaps to secure either the flag or banner to the pole. Finally, the securing device has an indentation in between the first and second panel to allow the pole to pass through the securing device.

1 Claim, 4 Drawing Sheets

APPARATUS AS A FLAG OR BANNER POLE CLIP

BACKGROUND

1. Field

The present invention pertains generally to flags and securing flags to decorative flags or banners to support rods or poles.

2. Description of Related Art

Many people fly flags and banners, for example, as seasonal, holiday, or patriotic displays. Typically, flags and banner fly off their poles in especially windy conditions, but can work their way off and blow away with even a minor inducement. This can be inconvenient to try to secure the flag or banner so it remains on the pole, or having to look for it if it blows away. This can be expensive repeatedly replacing flags and banners that blow away. This can be frustrating repeatedly dealing with the problem.

Flags, banners, poles and flag retaining mechanisms are well known in the art. Several attempts have been made to create convenient and comfortable position-support or cushioning devices combined with toolbox or implement containers, as for example U.S. Pat. Nos. 5,975,009, 4,852,733, Des. 370,623, 310,652, 1,532,381 and 2,491,737. However, the preceding patents utilize complex and bulky designs.

BRIEF DESCRIPTION OF THE FIGURES

The present invention is illustrated by way of example and not limitation in the Figures of the accompanying drawings.

DETAILED DESCRIPTION

The following description provides an apparatus for a device that is a clip (10) to secure flags (11) and banners to poles (12). It will be appreciated, however, by one skilled in the art that the invention may be practiced without such specific details. Those of ordinary skill in the art, with the included descriptions, will be able to implement appropriate production and assembly without undue experimentation.

As previously described, various problem exist for prior art flag securing mechanisms. For example, they do not accommodate poles of most designs. In contrast, in one aspect, the claimed subject matter can be produced to accommodate pole dimensions. For example, they utilize complex and bulky designs. In contrast, in one aspect, the claimed subject is simple to manipulate with one-handed compression on either side of the top edges to open the bottom gripping edge, which is in the closed, secured position due to the nature of its design. Thus, to secure a flag on a pole, one need only release the mechanism with the gripping edges of the panels on either side of the pole. For example, they are esthetically unappealing. In contrast, the claimed subject depicts an attractive form. In one embodiment, the claimed subject matter depicts appealing designs and motifs.

Figure 1:
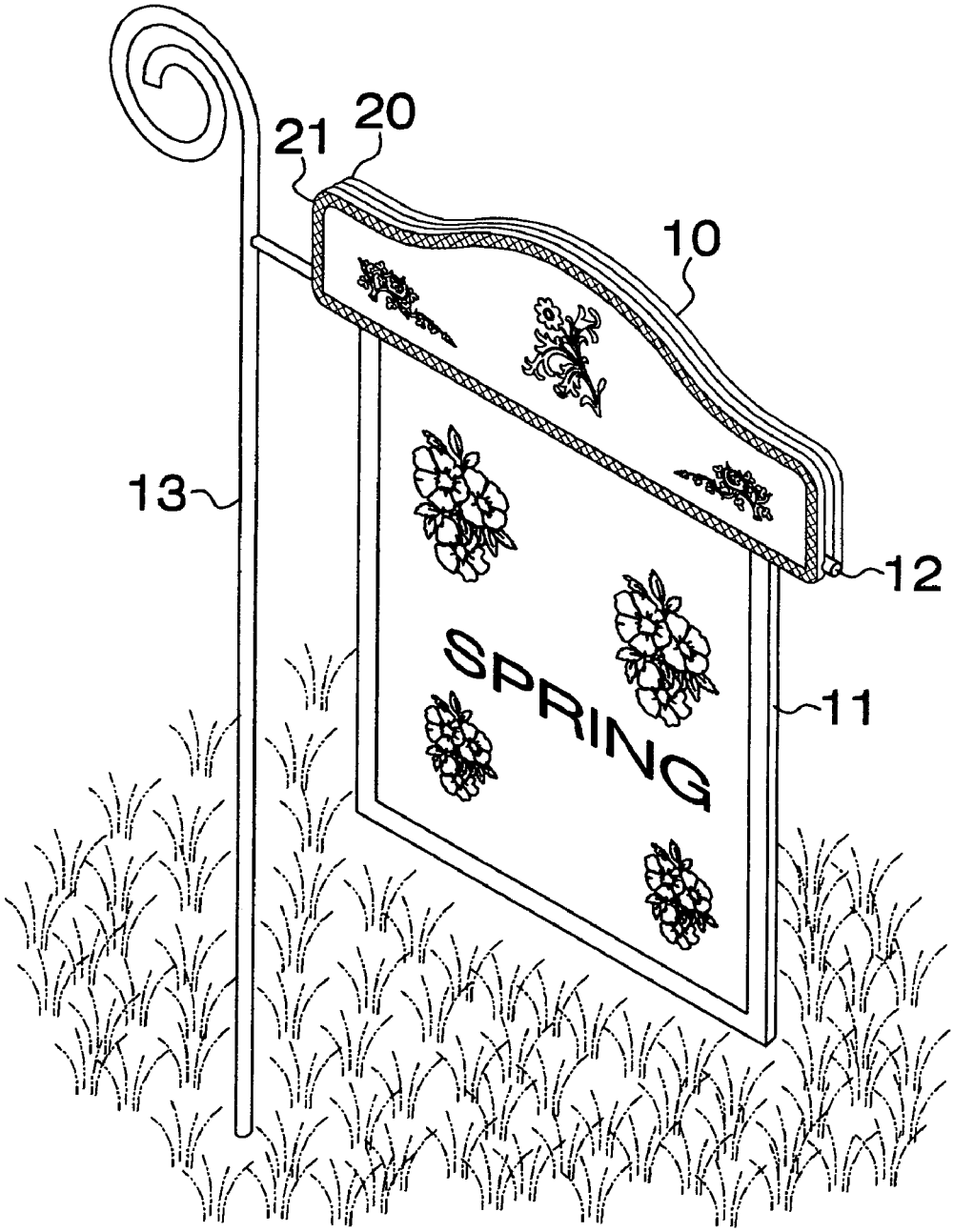
FIG. 1 illustrates a general perspective view of an apparatus utilized in accordance with an embodiment.
Figure 2:
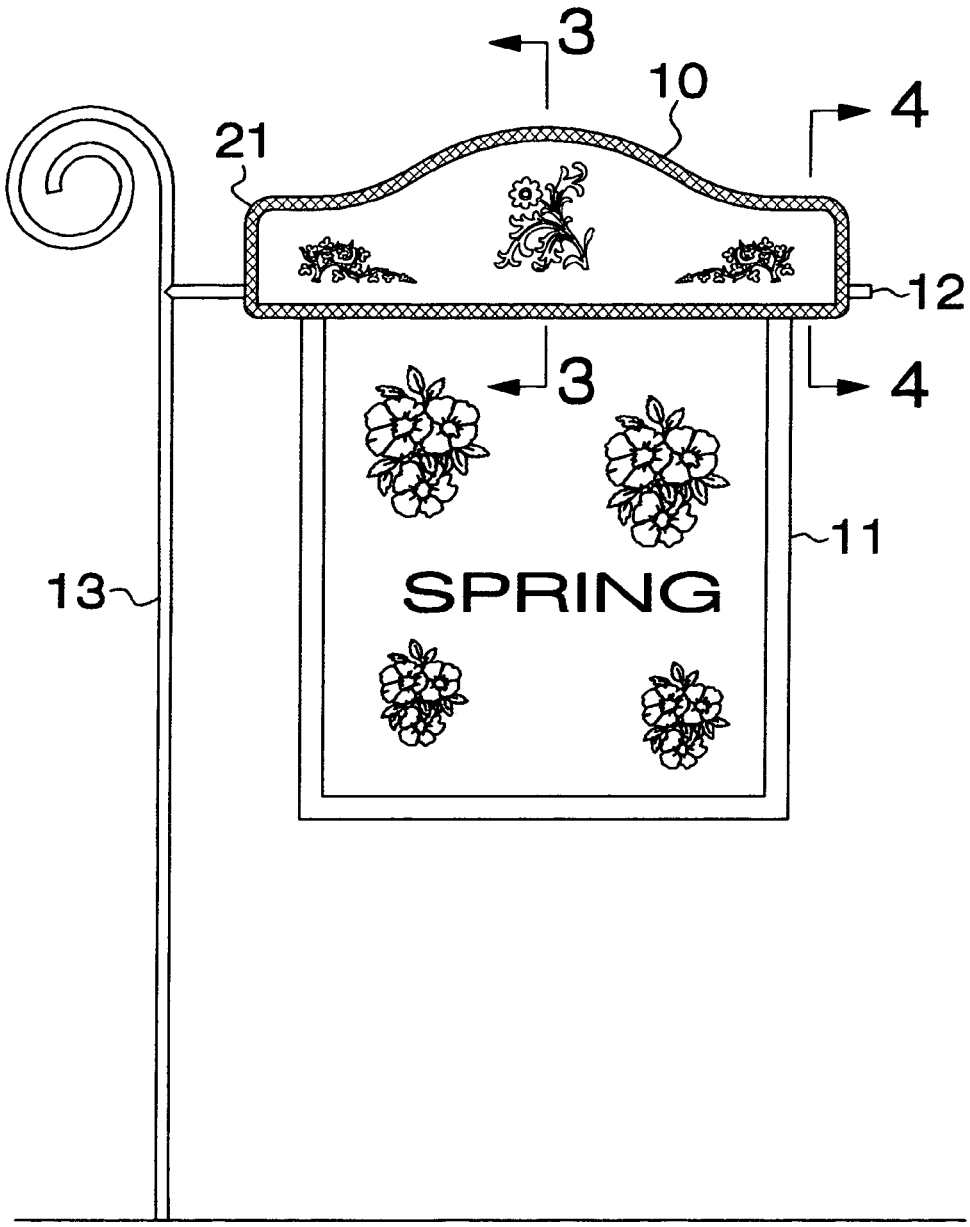
FIG. 2 illustrates a general perspective view of the apparatus utilized in accordance with the embodiment depicted in FIG. 1.
Figure 3:
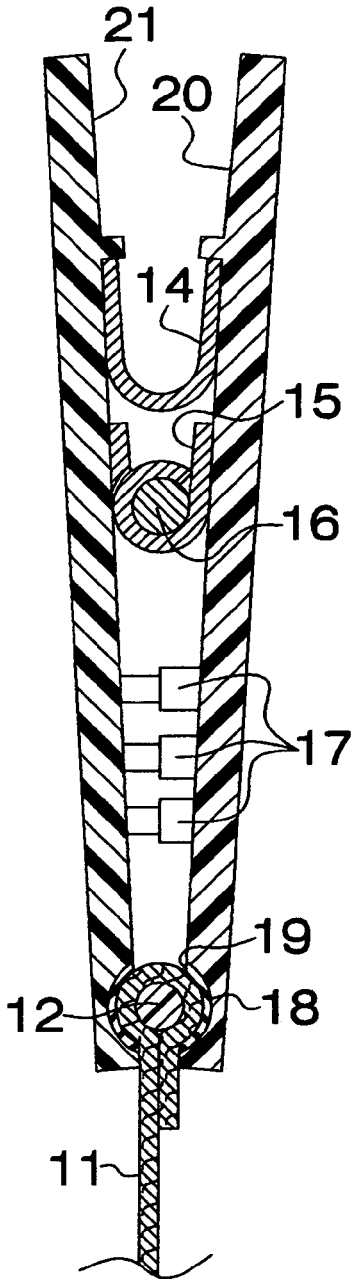
FIG. 3 illustrates a cross-section open view of the apparatus utilized in accordance with the embodiment depicted in FIG. 1.
Figure 4:
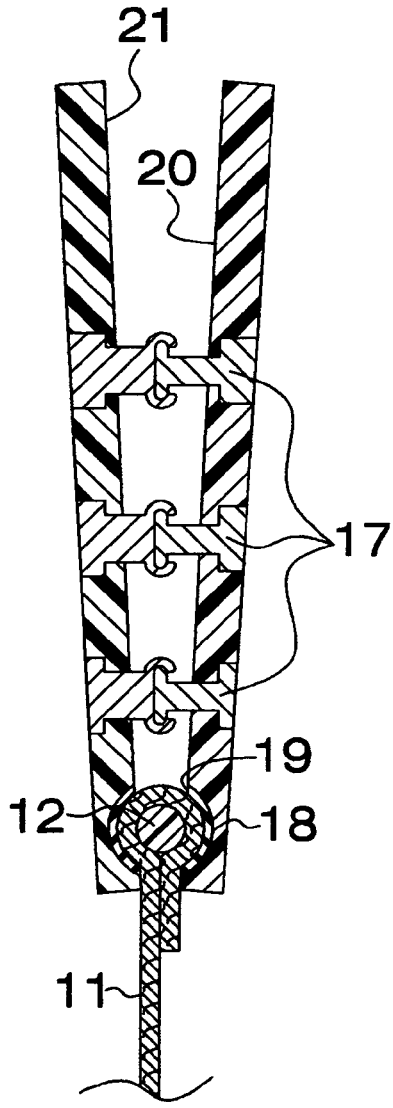
FIG. 4 illustrates a cross-section secured view of the apparatus utilized in accordance with the embodiment depicted in FIG. 1.
Figure 5:
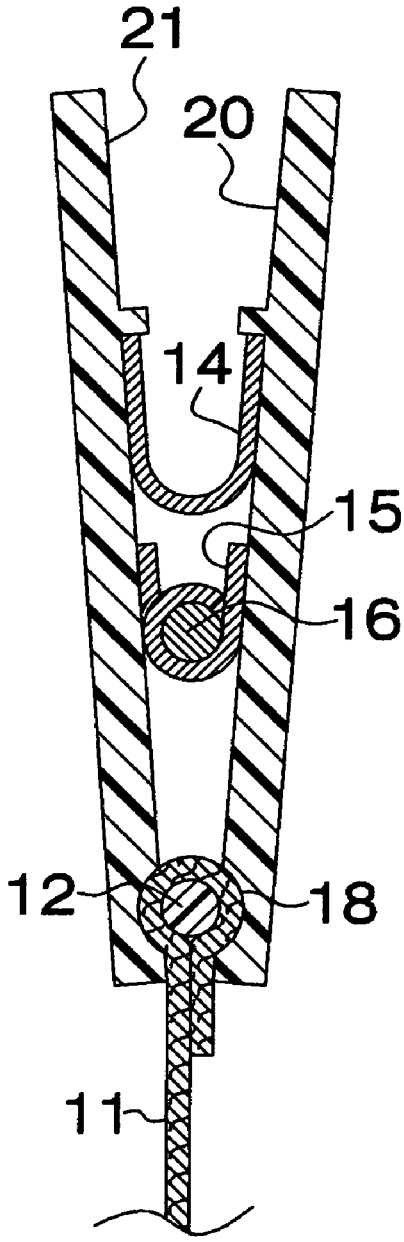
FIG. 5 illustrates a cross-section view of an alternative embodiment without snaps.

FIG. 1 illustrates a general perspective elevated front view of an apparatus utilized in accordance with an embodiment. The figure depicts the device atop a horizontal pole, securing a flag hanging down vertically. The figure depicts the flagpole (13) as extending from a ground stake support pole of the shepard's hook design that is planted in the ground. The figure depicts the device in the secure position, with the end of a pivot dowel mechanism visible on the side, just above the clip edge. FIG. 2 illustrates a general perspective eye-level view of the apparatus utilized in accordance with the embodiment depicted in FIG. 1. FIG. 3 illustrates a cross-section view of the apparatus in a different embodiment. The figure depicts a device with an internal mechanism with a U-shaped spring (14) with the open end uppermost at the top, a hinge (15) around a pivot rod (16), and three snaps fasteners (17) in the open position, and a indentation (18) on the inner panel at the bottom clip tip. The figure depicts the device with the indentation a rubber, semicircular lining (19) for a more secure grip. The figure depicts the device with the flag on a pole inserted into the device. FIG. 4 illustrates a cross-section view of the apparatus utilized in accordance with the embodiment depicted in FIG. 3. The figure depicts a device with three snap fasteners in the secured position and a flag on a pole inserted into the device. FIG. 5 illustrates a cross-section alternate embodiment view of the apparatus. The figure depicts the device without the snap fasteners.

FIG. 1 illustrates the device retaining a flag on a pole. The device is artistically shaped with an arching top and artistically decorated with a seasonal motif so as to be esthetically pleasing and adding not detracting from the decorative nature of the flag and pole. The figure depicts the device securing a flag mounted on the pole and extending the full length of the flag. The figure depicts the device when embodied in a small size measuring eight inches long, one-half inches wide and three inches high. Embodied in a larger size, the device measures 14 inches long, three-fourths inches wide and five inches high.

FIG. 2 illustrates a general perspective view of the apparatus utilized in accordance with the embodiment depicted in FIG. 1.

FIG. 3 illustrates a cross-section open view of the apparatus in a different embodiment. Each of the two panels (20, 21) is composed of one of the following materials: plastic, soapstone, metal or wood. The two panel sides are joined together, from top to bottom, with: a flat, U-shaped metal or plastic spring held in position by built-in spring retainer grooves on each panel. Heavy-duty glue is used in conjunction with the retainers to assure secure retention. The figure depicts that just below the U-shaped spring is a spring hinge and pivot rod mechanism attached to the inner panel. The dowel runs through the opening in the spring hinge center. The figure depicts that just below the spring hinge dowel a three adjacent snap fasteners in the open position, one below the next. The figure depicts that just below the snap fasteners is the gripping end of the device, a rubber lined dowel-shape routed out the length of the two panels to fit the pole.

FIG. 4 illustrates a cross-section secured view of the apparatus utilized in accordance with the embodiment depicted in FIG. 3. The figure depicts the device with snap fasteners that are in the secured position. The snap-fasteners are of the male/female design common to the art. The figure depicts the device with the snap fasteners as attached to the device by the means of having the bases inserted into the inner panel of the clip on each side. The figure depicts the snap fasteners as being visibly unobtrusive.

FIG. 5 illustrates a cross-section alternate embodiment view of the apparatus. In this alternative embodiment, there is no snap fasteners.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. An apparatus to secure a flag or banner to a pole comprising: a u-shaped spring above a pivot rod and in between a first and second panel; a plurality of snaps in between the first and second panel to be in either an opened or closed position and below the pivot rod to secure either the flag or banner to the pole; an indentation in between the first and second panel formed by routing out the width of the first and second panels, so that the pole and flag fit within the indentation to allow the pole to pass through; a pivot rod mechanism comprising a spring hinge and said pivot rod, said pivot rod mechanism being located just below and entirely spaced apart from the u-shaped spring, wherein said pivot rod mechanism is attached to the first panel, the pivot rod fitting through an opening in the spring hinge; and a rubber, semicircular lining along the indentation; wherein said plurality of snaps are located between said pivot rod mechanism and said indentation.

* * * * *